US011566569B1

(12) United States Patent
Kennedy et al.

(10) Patent No.: US 11,566,569 B1
(45) Date of Patent: Jan. 31, 2023

(54) METHOD AND SYSTEM FOR IDENTIFYING ABNORMAL VALVE PERFORMANCE IN AN INTERNAL COMBUSTION ENGINE

(71) Applicant: Caterpillar Inc., Peoria, IL (US)

(72) Inventors: Joseph L. Kennedy, Peoria, IL (US); Nathan Ankersen, Metairie, LA (US); Ryan A. Rush, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/453,124

(22) Filed: Nov. 1, 2021

(51) Int. Cl.
*F02D 41/22* (2006.01)
*F02D 35/00* (2006.01)

(52) U.S. Cl.
CPC ..... *F02D 35/0092* (2013.01); *F02D 41/22* (2013.01); *F02D 2200/101* (2013.01)

(58) Field of Classification Search
CPC . F02D 35/0092; F02D 41/22; F02D 2200/101
USPC .... 123/90.15, 672, 676, 688, 690, 691, 692; 701/103–105, 107; 73/114.69, 114.71
See application file for complete search history.

(56) References Cited

U.S. PATENT DOCUMENTS

| | | | | |
|---|---|---|---|---|
| 5,138,874 | A | 8/1992 | Davis | |
| 6,101,442 | A | 8/2000 | Lewandowski et al. | |
| 6,976,459 | B2 | 12/2005 | Kagy et al. | |
| 7,634,981 | B2 | 12/2009 | Dea et al. | |
| 2018/0156149 | A1* | 6/2018 | Campagna | G01M 15/05 |

FOREIGN PATENT DOCUMENTS

| | | |
|---|---|---|
| GB | 2383639 B | 8/2003 |

* cited by examiner

*Primary Examiner* — Hai H Huynh
(74) *Attorney, Agent, or Firm* — Bookoff McAndrews, PLLC

(57) ABSTRACT

Systems and techniques for identifying abnormal exhaust valve performance of an internal combustion engine may include receiving exhaust passage temperature signals from a plurality of exhaust passage temperature sensors, each exhaust passage being fluidly connected to one or more exhaust valves of the internal combustion engine, the exhaust passage temperature signals being indicative of respective exhaust passage temperatures. The method may further include comparing one or more of the exhaust passage temperatures, identifying a caution exhaust passage temperature, from one or more of the exhaust passage temperatures, that deviates from one or more of the other one or more exhaust passage temperatures, and outputting an abnormal exhaust valve performance indication based on identifying the caution exhaust passage temperature.

20 Claims, 4 Drawing Sheets

METHOD AND SYSTEM FOR IDENTIFYING ABNORMAL VALVE PERFORMANCE IN AN INTERNAL COMBUSTION ENGINE

TECHNICAL FIELD

The present disclosure relates generally to internal combustion engine systems, and more particularly, to methods and systems for identifying abnormal valve performance of an internal combustion engine.

BACKGROUND

Internal combustion engines create harsh, high-temperature environments that can change the properties of engine components over time. High-performance engines, including natural gas engines, diesel engines, and dual fuel engines (engines capable of combusting both natural gas and diesel fuel), operate at particularly high temperatures. Engine valves, such as exhaust valves, necessarily operate in these high temperature environments. Over time, such valves can experience deteriorating performance as a result of carbon buildup, tolerance changes, flaking of material, or the like. Existing systems for determining such abnormal performance often do so after a component failure. Such component failures can be costly and often render a given engine inoperable for an extensive amount of time.

An exemplary fault condition detection system is disclosed in UK Patent No. 2,383,639 to Lewandowski et al. (the '639 patent). The system described in the '639 patent determines temperature values of air in an intake manifold. Dramatic variance in these temperature values, can be identified to determine that an intake valve failure has occurred. While the system disclosed in the '639 patent may be useful for intake manifolds, it is not helpful for detecting failure in other internal combustion engine components such as exhaust valves or during conditions such as low engine power modes.

The disclosed method and system may solve one or more of the problems set forth above and/or other problems in the art. The scope of the current disclosure, however, is defined by the attached claims, and not by the ability to solve any specific problem.

SUMMARY

In one aspect, a method for identifying abnormal exhaust valve performance of an internal combustion engine may include receiving exhaust passage temperature signals from a plurality of exhaust passage temperature sensors, each exhaust passage being fluidly connected to one or more exhaust valves of the internal combustion engine, the exhaust passage temperature signals being indicative of respective exhaust passage temperatures. The method may further include comparing one or more of the exhaust passage temperatures, identifying a caution exhaust passage temperature, from one or more of the exhaust passage temperatures, that deviates from one or more of the other one or more exhaust passage temperatures, and outputting an abnormal exhaust valve performance indication based on identifying the caution exhaust passage temperature.

In another aspect, a method for identifying abnormal exhaust valve performance of an internal combustion engine may include determining that the internal combustion engine is operating below a predetermined engine load, below a predetermined engine speed, or both. The method may further include receiving valve temperature signals from a plurality of temperature sensors, the valve temperature signals corresponding to respective valve temperatures, determining a representative temperature based on the valve temperatures, identifying when one or more of the valve temperatures is greater than a threshold temperature above the representative temperature, and outputting an abnormal valve performance indication based on identifying the one or more valve temperatures is greater than the threshold temperature.

In yet another aspect, an abnormal exhaust valve performance detection system may include an internal combustion engine including a plurality of exhaust passages, each exhaust passage being connected to one or more exhaust valves of the internal combustion engine. The system may include a plurality of temperature sensors, each temperature sensor secured to a respective exhaust passage and a control unit. The control unit may be configured to receive exhaust passage temperature signals from each of the plurality of temperature sensors, the exhaust passage temperature signals being indicative of respective exhaust passage temperatures, determine a representative temperature based on each of the exhaust passage temperatures, compare one or more of the exhaust passage temperatures to the representative temperature, identify a caution exhaust passage temperature, from one or more of the exhaust passage temperatures, that is greater than at least a threshold temperature above the representative temperature, based on the comparison, and output an abnormal exhaust valve performance indication based on identifying the caution exhaust passage temperature.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

Figure 1:
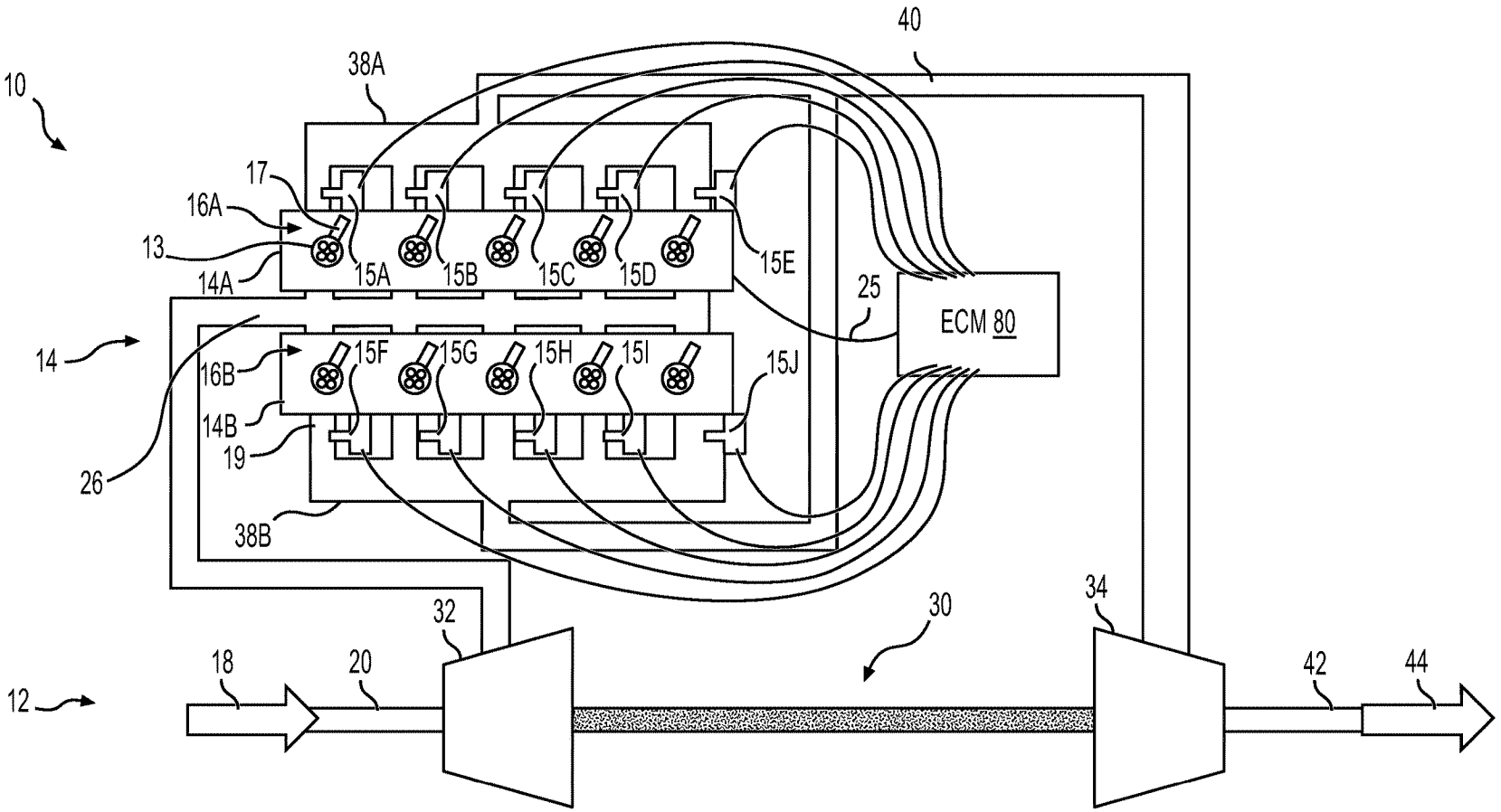
FIG. 1 is a schematic diagram illustrating an abnormal valve identification system according to an aspect of the present disclosure.

FIG. 1 illustrates an exemplary internal combustion engine system 10 according to aspects of the present disclosure. Engine system 10 may include an air supply system 12 and an internal combustion engine 14 which receives air, and in some configurations, gaseous fuel, introduced with supply system 12. Engine 14 may include a first engine bank 14A and second engine bank 14B each including a plurality of cylinders 16A and 16B, respectively, for the combustion of fuel. Engine 14 may include a plurality of fuel injectors 17 connected to each of the plurality of cylinders 16A and 16B and/or valves 13. Engine 14 may be configured to combust gaseous fuel, either alone (e.g., via spark-ignition initiated with a spark plug) or together with liquid fuel, such as diesel (e.g., by compression-ignition of liquid fuel to initiate combustion). The gaseous fuel may include natural gas (e.g., a mixture of methane and one or more of ethane, butane, and propane), propane gas, methane gas, a biogas, a mixture thereof, or any other suitable fuel that can be supplied to intake cylinders 16 in gaseous form. Alternatively, engine 14 may be configured for combustion of diesel fuel, gasoline, or another type of liquid fuel, in the absence of a gaseous fuel.

Air and fuel supply system 12 may include an air inlet 18 to supply air to cylinders 16A and 16B, and a low pressure inlet air passage 20. Air and fuel supply system 12 may also include components for the storage and supply of gaseous fuel (not shown). As used herein, "gaseous fuel" may include, in addition to fuel stored in gaseous form, fuel stored in a liquid form and supplied, in gaseous form, via air and fuel supply system 12.

Air inlet 18 may allow clean intake air to enter air and fuel supply system 12 and may include one or more air filters, for example. Low pressure inlet air passage 20 may be connected to air inlet 18 upstream of a compressor 32 of turbocharger 30.

An outlet of compressor 32 may be connected to cylinders 16A and 16B of engine 14 via an intake manifold. Downstream of cylinders 16A and 16B, exhaust manifolds 38A and 38B may be respectively connected to an inlet of turbine 34 by a high pressure exhaust passage 40. An outlet of turbine 34 may be connected to a low pressure exhaust passage 42. Low pressure exhaust passage 42 may include one or more aftertreatment systems, such as catalysts, filters, etc. (not shown). Exhaust may exit engine system 10 through an exhaust outlet 44 downstream of passage 42 after passing through any aftertreatment systems of system 10. One or both of exhaust manifolds 38A and 38B may be fluidly connected to an exhaust gas recirculation system (not shown) to allow a portion of the exhaust to return to intake manifold 26 when desired.

Cylinders 16A and 16B may be connected to a plurality of exhaust passages 19 of exhaust manifolds 38A and 38B, each exhaust passage 19 being connected downstream of one or more exhaust valves 13 and a corresponding exhaust port within the cylinder head for engine banks 14A and 14B. Each exhaust valve 13 may be upstream of a respective temperature sensor 15A-15J (e.g., temperature sensors 15A-15J may detect exhaust temperatures via one or more exhaust valves 13 or via an exhaust passage attached to one or more exhaust valves). It will be understood that each exhaust valve 13 may be a set of exhaust valves including two or more exhaust valves (two exhaust valves and two intake valves being shown in FIG. 1). Temperature sensors 15A-15J may be configured to detect the temperature at an exit point of each respective exhaust valve 13, or an exhaust valve set comprising two or more exhaust valves 13 continuously or periodically. Temperature sensors 15A-15J may be placed at an exit portion of a valve or may be placed in an exhaust passage 19 that receives the exhaust from one or more valves 13. Temperature sensors 15A-15J may be placed such that a sensing component, such as a thermistor, of each temperature sensor 15A-15J protrudes at least partially inside a respective exhaust passage 19, such that a detected temperature corresponds to the exhaust gas within respective exhaust passages 19. Temperature sensors 15A-15J may be connected to a battery or via one or more components of engine system 10, or may be powered by individual batteries. Temperature sensors 15A-15J may output temperature signals received at an electronic control module (ECM) 80 of system 10. ECM 80 may be configured to output temperature signals to one or more "back office" or remote systems 82 (FIG. 2) that are configured to analyze the received temperature signals and identify when the signals indicate a potential abnormal valve condition, as described below. Remote system 82 may be an on-site computer that is separate from a machine (e.g., a computer system in local wireless communication with the machine), an off-site computer (e.g., a computer system in wide area wireless communication with the machine).

ECM 80 may be configured to control one or more components of the engine system 10 including, for example, one or more fuel injectors 17. Fuel injectors 17 may inject a fuel such diesel fuel for combustion via engine system 10, either alone or for combustion of gaseous fuel (e.g., by employing diesel as a pilot fuel). In at least some configurations, fuel injectors 17 may be configured for injection of gasoline. Each set of exhaust valves 13 connected to an exhaust passage 19 may have a corresponding fuel injector 17. An engine signal 25 may be generated by any applicable engine system 10 component (e.g., a processor, a load sensor, a speed sensor, etc.). Engine signal 25 may indicate an engine load, an engine speed, or may be two signals, a first providing information to determine an engine load and the second indicating an engine speed. Engine signal 25 may be provided to ECM 80 and may correspond to a current engine load (e.g., based one or more of a torque, a pressure, or the like) and/or engine speed. While engine system 10 is described herein based on a first engine bank 14A and second engine bank 14B, it will be understood that the techniques disclosed herein may be implemented using any applicable number of engine banks such as one or more engine banks. Additionally, while engine system 10 is described herein based on a given number of temperature sensors 15A-15J, a given number of fuel injectors 17, and a given number of exhaust valves 13, a given number of exhaust passages 19, techniques described herein may be applicable for any number of temperature sensors, fuel injectors, exhaust passages, and/or exhaust valves.

Figure 2:
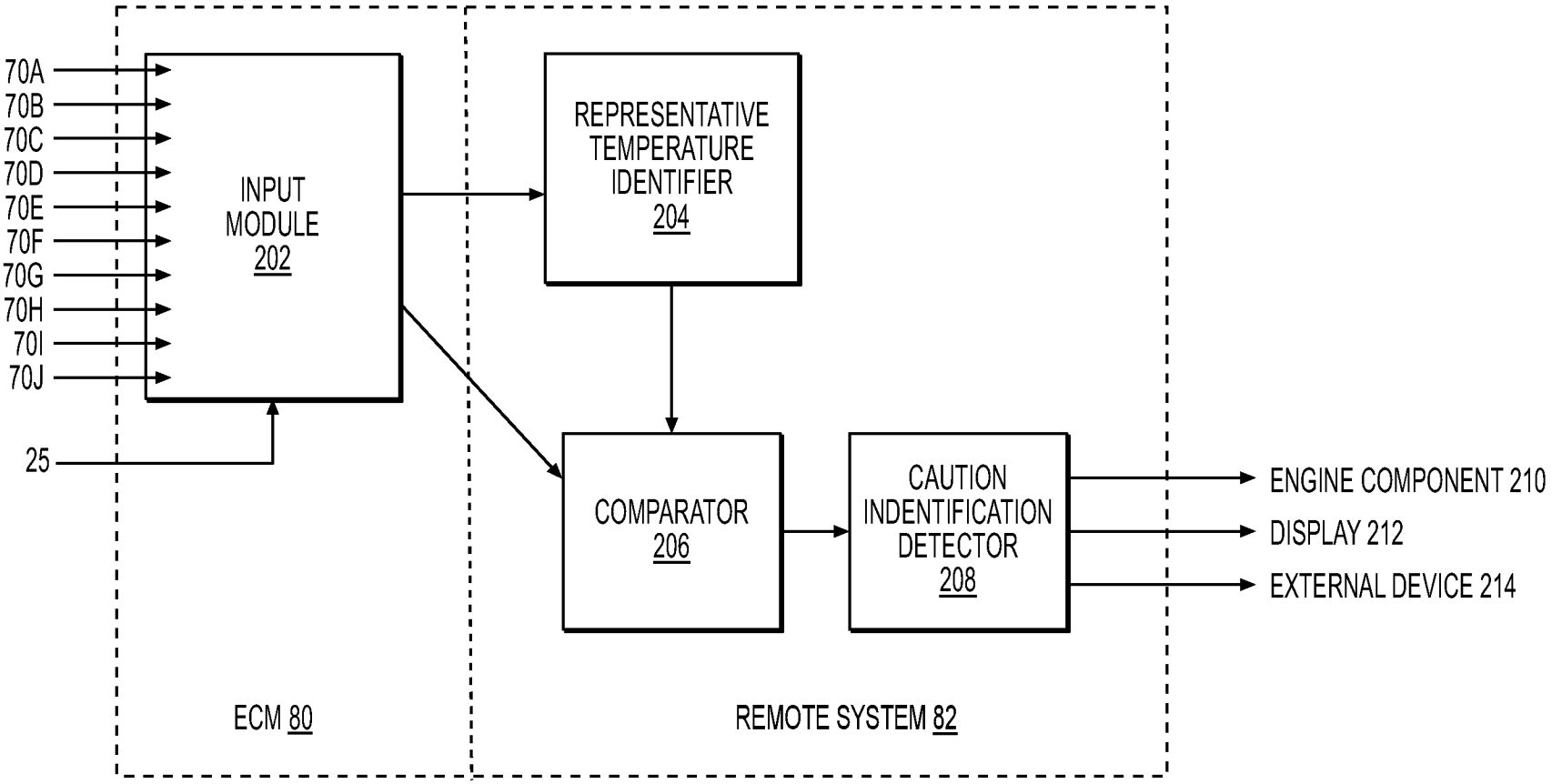
FIG. 2 is a block diagram illustrating an exemplary configuration of a controller of the abnormal valve identification system of FIG. 1.

FIG. 2 is a block diagram illustrating an exemplary configuration of ECM 80 and remote system 82. ECM 80 may receive, as inputs, temperature signals 70A-70J, respectively, from each temperature sensor 15A-15J. The temperature signals 70A-70J may be transmitted to remote system 82, to ECM 80, or to both continuously, periodically, upon a request signal from ECM 80 or other component, upon one or more thresholds, or the like. ECM 80 may receive additional inputs from other sensors or feedback devices to monitor the operation of engine system 10 (e.g., engine signal 25). A transmitting component of the ECM 80 or separate from the ECM 80 may communicate temperature signals 70A-70J to remote system 82. The transmitting component may communicate the temperature signals 70A-70J over a wireless connection (e.g., a cellular connection, a WiFi connection, a Bluetooth connection, etc.). ECM 80 and/or remote system 82 may be configured to provide, as outputs, control signals to display 212, one or more fuel injectors 17, one or more engine components 210 other than fuel injectors 17, and/or an external device 214 (e.g., a remote computer, portable computer, cellular device, etc.). For example, remote system 82 and/or ECM 80 may cause display 212 (e.g., a display of remote system 82, a mobile computing device in communication with remote system 82, ECM 80, or both, or a display secured to engine system 10 and electrically connected to ECM 80) to present notifications or alerts based on the temperature signals 70A-70J received from temperature sensors 15A-15J. Remote system 82 may generate a command (e.g., at caution identification detector 208) and may transmit the command to ECM 80. ECM 80 may receive the command and may output control signals to display 212, one or more fuel injectors 17, one or more engine components 210 other than fuel injectors 17, and/or an external device 214.

Each temperature signal 70A-70J may correspond to a respective exhaust passage 19 temperature and/or valve 13 temperature. For example, temperature signals 70A-70J may be generated by directly measuring a temperature of exhaust generated by combustion of fuel, the exhaust being present in a passage of an exhaust manifold downstream of an intake manifold 26 and downstream of an engine cylinder. ECM 80 and/or remote system 82 may receive additional inputs, such as inputs from one or more sensors for monitoring other aspects of the operation of engine system 12 (e.g., engine signal 25). ECM 80 and/or remote system 82 may provide, as outputs, commands for display 212, commands for one or more external devices 214, and/or commands for one or more engine components 210 to trigger one or more actions such as a warning, display notification, alert, engine component (e.g., a fuel injector 17) operational change (e.g., a shutoff or modification), or the like or a combination thereof. ECM 80 and/or remote system 82 may include (e.g., may be programmed with) a representative temperature identifier 204 configured to identify a representative temperature based on a plurality of input temperature signals 70A-70J, a comparator 206 that compares the various input temperature signals 70A-70J to the representative temperature, and a caution identification detector 208 to identify a caution exhaust passage temperature. ECM 80 and/or remote system 82 may be configured to determine whether a temperature signal from the input temperature signals 70A-70J deviates from the other input temperature signals 70A-70J. For example, representative temperature identifier 204 may output a representative temperature and the input temperature signals 70A-70J may be compared to the representative temperature to determine if any of the input temperature signals 70A-70J deviates from the representative temperature by a threshold amount.

Figure 4:
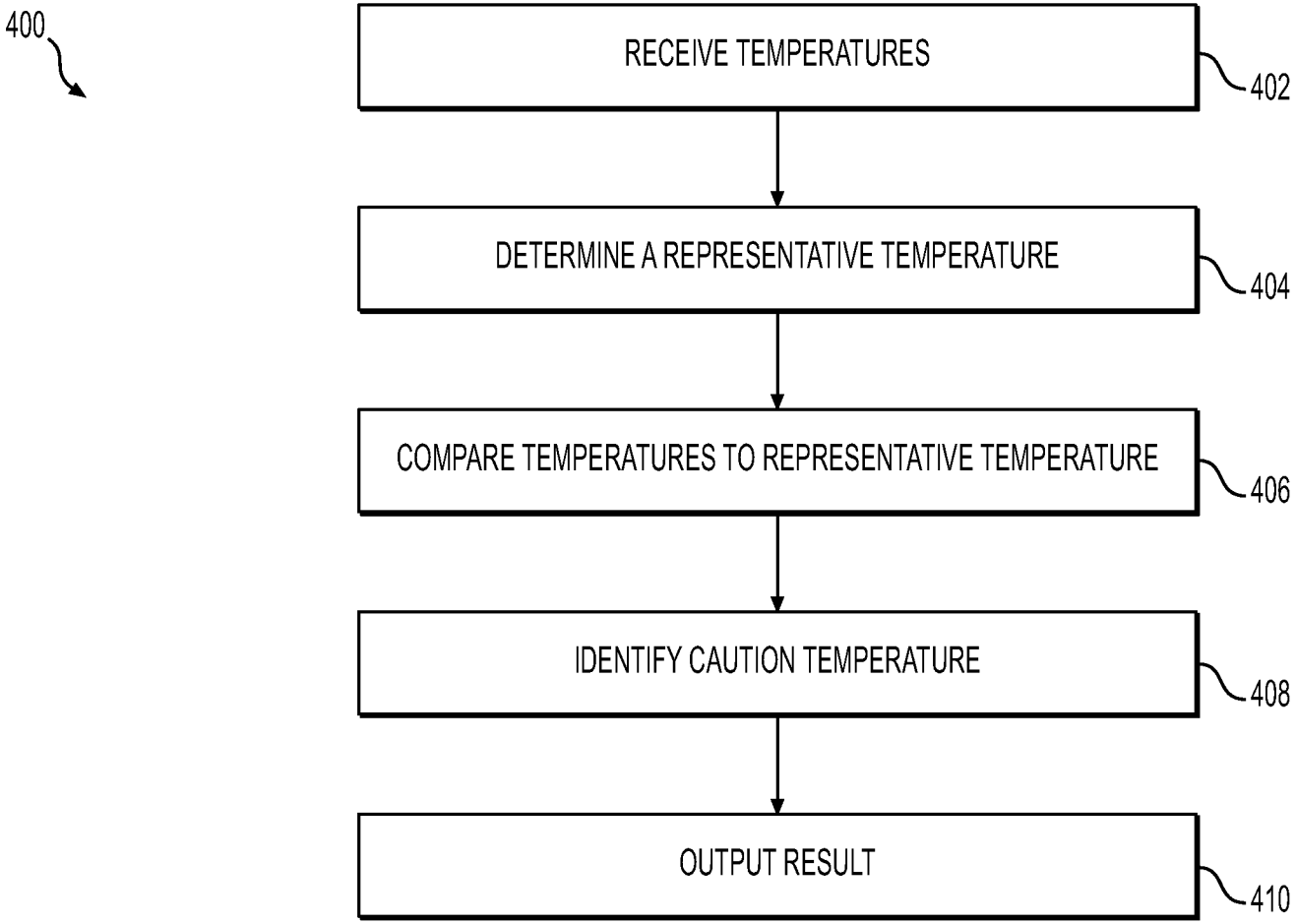
FIG. 4 is a flowchart illustrating an exemplary method according to an aspect of the present disclosure.

ECM 80 and/or remote system 82 may embody a single microprocessor or multiple microprocessors that receive inputs (e.g., input temperature signals 70A-70J, engine signal 25) and issue control signals or other outputs (e.g., commands for display 212, one or more external devices 214, and/or one or more engine components 210). Representative temperature identifier 204, comparator 206, and/or caution identification detector 208 may be implemented using the single microprocessor, multiple microprocessors and/or one or more other computing components associated with ECM 80 and/or remote system 82. ECM 80 and/or remote system 82 may include a memory, a secondary storage device, a processor, such as a central processing unit, or any other means for accomplishing a task consistent with the present disclosure. The memory or secondary storage device associated with ECM 80 and/or remote system 82 may store data and software to allow ECM 80 and/or remote system 82 to perform its functions, including each of the functions described with respect to method 400 (FIG. 4). In particular, such data and software in memory or secondary storage device(s) may allow ECM 80 and/or remote system 82 to perform the functions associated with representative temperature identifier 204, comparator 206, and/or caution identification detector 208, as well as generating outputs for engine component 210, display 212, and/or external device 214. The memory or secondary storage may also store one or more algorithms (e.g., one or more algorithms to determine a representative temperature, one or more algorithms for identifying a caution temperature, etc.). Further, the memory or secondary storage device associated with ECM 80 and/or remote system 82 may store data received from one or more of the input temperature signals 70A-70J from temperature sensors 15A-15J or engine signal 25 of system 10. Numerous commercially available microprocessors can be configured to perform the functions of ECM 80 and/or remote system 82. Various other known circuits may be associated with ECM 80 and/or remote system 82, including signal-conditioning circuitry, communication circuitry, and other appropriate circuitry.

Temperature sensors 15A-15J may detect the temperature at respective exhaust passages 19, as shown in FIG. 1, or may detect the air temperature from or more valves 13 directly. For example, a portion of temperature sensors 15A-15J may be positioned at the exit of a valve 13 such that it measures the exhaust output by valve 13 (e.g., rather than measuring the exhaust in an exhaust passage that may receive exhaust from multiple valves 13). The temperature at the exhaust passages 19 and/or valves 13 may be the temperature of exhaust at the one or more valves 13 or a respective exhaust passage 19 downstream of one of valves 13. The exhaust temperature sensed by temperature sensors 15A-15J may be approximately the same across the multiple exhaust passages 19 and/or valves 13 in a given engine bank (e.g., engine bank 14A or 14B), during normal operation of engine 14. However, abnormal valve performance (e.g., for one or more exhaust valves 13) may cause a deviation in a respective temperature sensed by at least one of the temperature sensors 15A-15J. The abnormal valve performance may be caused by, for example, incomplete closure of a valve or a valve fracture (e.g., a fracture of a portion of valve 13 or a cover of valve 13). An incomplete closure of a valve or a valve fracture may be caused by, for example, carbon buildup, tolerance changes (e.g., due to buildup of contamination), and/or flaking of material. Abnormal valve performance may be detected by determining that an exhaust passage temperature is a predetermined amount or more above a representative exhaust passage temperature. When this occurs, ECM 80 and/or remote system 82 may determine that a detected exhaust passage temperature is a so-called "caution exhaust passage temperature." Additionally or alternatively, abnormal valve performance may be detected by determining that a valve temperature deviates a predetermined amount or more above a set of valve temperatures (e.g., input temperature signals 70A-70J). A valve temperature that deviates the predetermined amount or more may be a so-called "caution valve temperature." For example, abnormal valve performance may be detected by determining that a valve temperature deviates a predetermined amount or more above a representative valve temperature, resulting in a caution valve temperature. The representative temperature may be a temperature that is determined based on the temperature signals 70A-70J, as further discussed below. The threshold amount may be a warning threshold at which ECM 80 and/or remote system 82 may generate a warning provide via, for example, display 212 or a modification threshold at which ECM 80 and/or remote system 82 may trigger an engine modification such as a fuel injector 17 shutoff, fuel amount modification, or the like, as further discussed herein.

Input temperature signals 70A-70J may be received by input module 202, which may also receive engine signal 25. In one aspect, input module 202 may convert input temperature signals 70A-70J to temperatures, each temperature corresponding to a respective exhaust passage 19 or valve 13. Input temperature signals 70A-70J may be received at ECM 80 and/or remote system 82 on a periodic basis, at predetermined times, or based on one or more triggers. The periodic basis and/or predetermined times may be programmed and temperature sensors 15A-15J may automatically provide temperature signals 70A-70J continuously or based on the periodic basis and/or predetermined times upon being powered (e.g., by a battery or any applicable component of engine system 10). One or more triggers may include, but are not limited to, a given engine load or speed, as provided via engine signal 25, a performance metric (e.g., vehicle speed), a test signal, or a combination thereof. The input temperature signals 70A-70J and/or engine signal 25 may be transmitted to ECM 80 and/or remote system 82 via a wired or wireless connection (e.g., via a Bluetooth®, Wi-Fi, or other applicable communication standard).

Representative temperature identifier 204 may receive the temperatures corresponding to temperature signals 70A-70J from the input module 202. Representative temperature identifier 204 may determine a representative temperature based on the received temperatures from input module 202. In one aspect, representative temperature identifier 204 may determine a representative temperature for each bank (e.g., engine bank 14A and 14B) of engine 14. For example, representative temperature identifier 204 may generate a first representative temperature based on temperature signals 70A-70E, corresponding to temperature sensors 15A-15E of engine bank 14A. Representative temperature identifier 204 may generate a second representative temperature based on temperature signals 70F-70J, corresponding to temperature sensors 15F-15J of engine bank 14B.

The representative temperature for a given engine bank may be based on a relationship (e.g., a mathematical relationship) between each of the temperatures corresponding to temperature signals 70A-70J. For example, the representative temperature may be a mean, mode, median, or any other applicable relationship between each of the temperatures corresponding to temperature signals 70A-70J. In some configurations, the representative temperature may be calculated by identifying one or more temperatures that deviate from the remaining temperatures, and calculating a mean, mode, or median based on the remaining temperatures for a particular engine bank. The representative temperature may refer to a temperature at a given point in time, at a given engine load, and/or may be a plurality of temperature points over a period of time and/or engine loads. In one aspect, the representative temperature may be based on one or more historical temperatures (e.g., a previous representative temperature) and/or an engine load. For example, an algorithm or machine learning model may be used to determine a representative temperature based on inputs. The inputs may include the temperatures corresponding to temperature signals 70A-70J, one or more historical representative temperatures, and/or a current engine load. Based on these inputs, a representative temperature may be determined for the current engine load.

Representative temperature identifier 204 may automatically identify a representative temperature for the temperatures calculated based on temperature signals 70A-70J upon receiving a full set of temperatures (i.e., corresponding to all temperature signals 70A-70J for one or both engine banks) from input module 202. According to this aspect, a representative temperature may be generated based on a full set of temperatures, corresponding to each temperature signal 70A-70J, for one or more engine banks. Alternatively, representative temperature identifier 204 may automatically identify a representative temperature corresponding to temperature signals 70A-70J upon receiving at least two temperatures for the same engine bank (i.e., corresponding to at least two temperature signals 70A-70J). According to this aspect, a representative temperature may be generated as long as at least two temperatures for a particular engine bank are available, without requiring each possible temperature to be available at representative temperature identifier 204.

Comparator 206 may receive the representative temperature from representative temperature identifier 204 and may receive the temperatures corresponding to temperature signals 70A-70J from input module 202 or representative temperature identifier 204. Comparator 206 may compare each of the temperatures corresponding to temperature signals 70A-70J to the representative temperature identified at representative temperature identifier 204. In one aspect, if the engine system 10 includes multiple engine banks (e.g., engine bank 14A and engine bank 14B), representative temperature identifier 204 may provide multiple respective representative temperatures. Accordingly, comparator 206 may compare temperatures corresponding to a given engine bank to a representative temperature for the same bank. Comparator 206 may determine whether one or more of the temperatures corresponding to the temperature signals 70A-70J deviates from the representative temperature.

Comparator 206 may identify the difference between each temperature corresponding to temperature signals 70A-70J and a corresponding representative temperature. For example, comparator 206 may identify the difference between each temperature corresponding to temperature signals 70A-70E to a representative temperature for engine bank 14A. Comparator 206 may identify the difference between each temperature corresponding to temperature signals 70F-70J to a representative temperature for engine bank 14B. The differences between given temperatures and representative temperatures may be provided to caution identification detector 208. Alternatively, or in addition, the differences may be stored in a memory associated with or in connection with ECM 80 and/or remote system 82.

Caution identification detector 208 may identify whether one or more differences between the received temperatures and representative temperatures exceed one or more thresholds to indicate a caution temperature. A caution temperature may be a temperature that exceeds a corresponding representative temperature by a warning threshold amount or a modification threshold amount. An exhaust passage or valve experiencing a caution temperature (i.e., a high temperature relative to a corresponding representative temperature) may be indicative of abnormal exhaust valve performance. In one aspect, the abnormal exhaust valve performance may represent the potential of a future abnormal performance such that the temperature-based indication may forecast the abnormal performance. In another aspect, the abnormal exhaust valve performance may be a current abnormal performance such that the temperature based indication may flag an abnormal performance.

A warning threshold amount may be a temperature amount over a representative temperature that raises to level of concern warranting a warning. Accordingly, a caution exhaust passage or valve temperature above a representative temperature by a warning threshold amount may trigger a warning at ECM 80 and/or remote system 82. A warning threshold amount may be pre-determined or may be determined based on a representative temperature. A higher representative temperature may correspond to either a higher or lower warning threshold amount relative to a lower representative temperature. For example, a representative temperature of 100 degrees Celsius may result in a warning threshold amount of 50 degrees, whereas a representative temperature of 180 degrees Celsius may result in a warning threshold amount of 40 degrees. As another example, a representative temperature of 100 degrees Celsius may result in a warning threshold amount of 50% above the representative temperature, whereas a representative temperature of 180 degrees Celsius may result in a warning threshold 40% above the representative temperature.

A warning generated based on a temperature exceeding the representative temperature and thus constituting a caution temperature may be output by ECM 80 and/or remote system 82 via display 212, as shown in FIG. 2. Alternatively, or in addition, a warning may be output via external device 214. The warning may include any applicable information including, but not limited to, identification information of an exhaust passage or valve exhibiting the caution temperature (e.g., by displaying a number that identifies a particular cylinder 16A, 16B), a temperature difference between a representative temperature and the caution temperature, a duration of time before abnormal valve behavior is expected, a notification, an alarm, or the like or a combination thereof.

A threshold for issuing a warning (referred to herein as a warning threshold) amount may be lower than a threshold for modifying operation of system 10 (referred to herein as a modification threshold amount). A modification threshold amount may be a temperature amount over a representative temperature that raises to level of concern warranting a modification to engine system 10. Accordingly, an exhaust passage or valve temperature that exceeds a representative temperature by the modification threshold amount may trigger a modification signal at ECM 80 and/or remote system 82. A modification threshold amount may be predetermined (e.g., set at a fixed value) or may instead be determined based on a representative temperature. A higher representative temperature may correspond to either a higher or lower modification threshold amount relative to a lower representative temperature. For example, a representative temperature of 100 degrees Celsius may result in a modification threshold amount of 80 degrees, whereas a representative temperature of 180 degrees Celsius may result in a modification threshold amount of 60 degrees.

A modification signal generated based on a caution temperature exceeding a representative temperature by at least a modification threshold amount may be output by ECM 80 and/or remote system 82 via engine component 210, display 212, and/or external device 214 as shown in FIG. 2. The modification signal may cause engine component 210 (e.g., a fuel injector 17) to modify its operation. The modification may be a state switch (e.g., an on to off, off to on, etc.), an increase or reduction in operation (e.g., a decreased amount of fuel supply), or the like. Thus, the modification signal may allow ECM 80 and/or remote system 82 to de-rate engine 14 or cause engine 14 to fully stop to prevent or reduce damage to one or more exhaust valves 13. It will be understood that reaching a modification threshold amount may also indicate reaching a warning threshold amount over a representative temperature, as a warning threshold amount is lower than a modification threshold amount. Accordingly, generating a modification signal may also be paired with generating a warning, based on reaching the modification threshold amount over a representative temperature.

In an aspect, ECM 80 and/or remote system 82 may implement one or more of representative temperature identifier 204, comparator 206, and/or caution identification detector 208 during a low engine load and/or low engine speed operation, for example when engine 14 is operating a predetermined engine speed or lower, a predetermined engine torque or lower, etc. A material difference in temperature (e.g., at least greater a warning threshold) may be more indicative of abnormal valve performance during low engine load and/or speed when compared to medium or high engine load and/or speed. Accordingly, it may be beneficial to identify a caution exhaust passage or valve temperature during low engine load and/or speed operation when compared to medium or high engine load and/or speed operation.

Engine load may correspond to an amount of power required of the engine and may be calculated, for example, based on engine speed. Engine signal 25 may provide an indication of an engine load (e.g., an engine speed while a set of temperature signals 70A-70J are received at ECM 80). A low engine load and/or speed operation may be approximately 40% or less of a maximum engine load and/or speed. Accordingly, input module 202 may provide temperatures to representative temperature identifier 204 and/or comparator 206 upon receiving an indication of a low engine load and/or speed based on engine signal 25.

It will be understood that the techniques disclosed herein may be implemented using ECM 80, using remote system 82, using a combination of ECM 80 and remote system 82, or may be implemented using any other applicable component. For example, temperature signals 70A-70J may be transmitted to remote system 82 directly from temperature sensors 15A-15J, via ECM 80 (as shown in FIG. 2), and/or via an intermediate component (e.g., a wireless communication device), and remote system 82 may include one or more of representative temperature identifier 204, comparator 206, and/or caution identification detector 208. Alternatively, ECM 80 may include one or more of representative temperature identifier 204, comparator 206, and/or caution identification detector 208. As used herein, the phrase "control unit" includes configurations where an electronic control unit associated with an engine (e.g., ECM 80) performs each of the functions described with respect to representative temperature identifier 204, comparator 206, and caution identification detector 208, configurations where a remote system (e.g., system 82) performs each of these functions, as well as configurations where an electronic control unit of an engine performs one or more of these functions and a remote system performs one or more of these functions.

INDUSTRIAL APPLICABILITY

Engine system 10 may be used in conjunction with any appropriate machine, power generation device, or vehicle that includes an internal combustion engine. For example, engine system 10 may be employed on machines such as natural gas power generators, dual-fuel power generators, excavators, dozers, loaders, trucks, or other machines or vehicles that include internal combustion engine system 10. During the operation of internal combustion engine system 10, ECM 80 and/or remote system 82 may monitor and/or control operations of engine components 210 such as fuel injectors 17. ECM 80 and/or remote system 82 may monitor the status of exhaust valves 13 via temperature signals 70A-70J generated by respective temperature sensors 15A-15J, may monitor the state of one or more engine system 10 components, and may generate warnings and/or determine a change in state of a given engine component 210, based on temperature signals 70A-70J.

Figure 3:
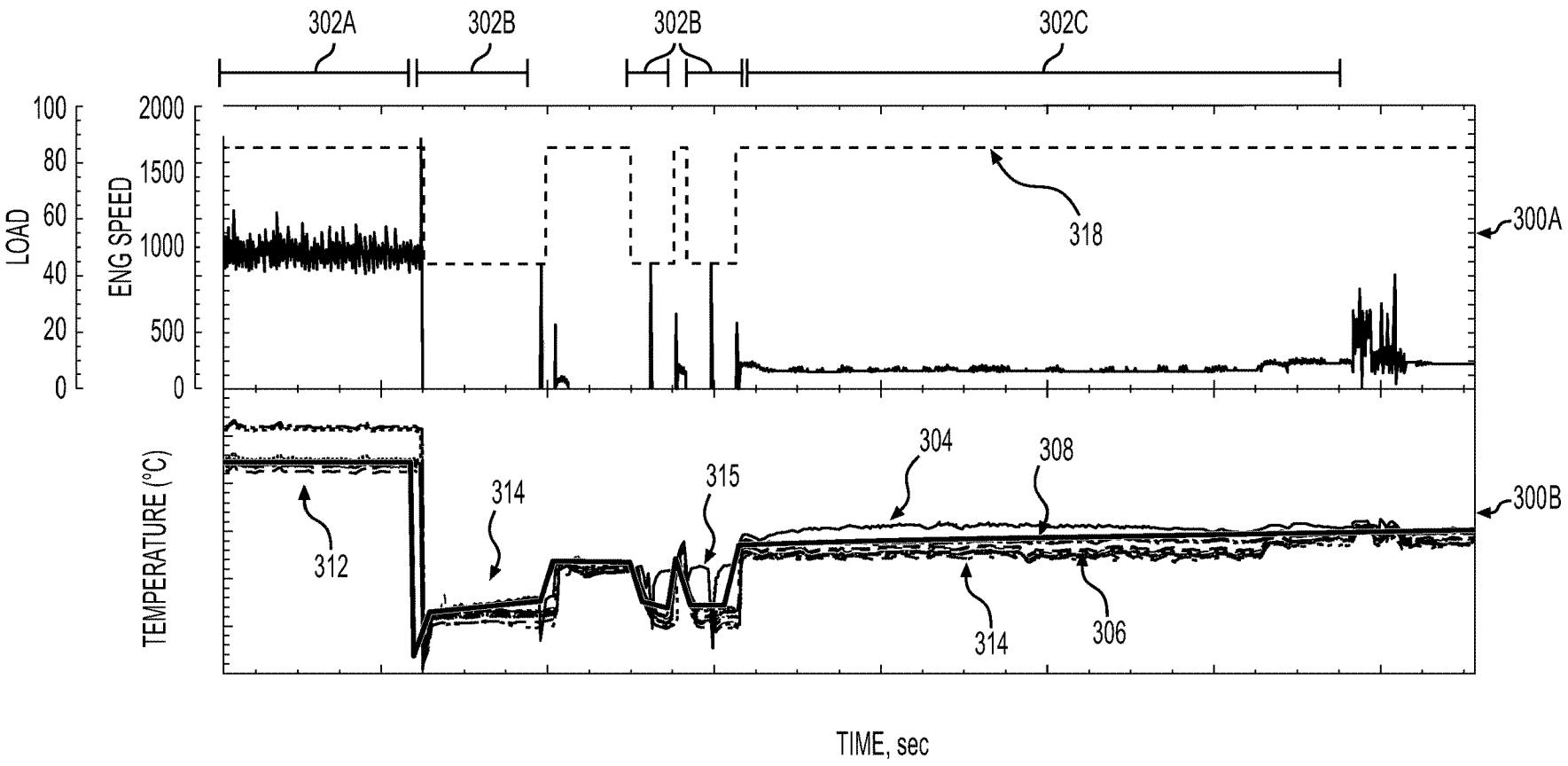
FIG. 3 includes graphs showing exemplary valve temperatures and engine speeds, according to an aspect of the present disclosure.

FIG. 3 shows a first graph 300A corresponding to engine speeds and engine loads on the Y-axis relative to time on the X-axis and a second graph 300B corresponding to valve temperatures on a different Y-axis than first graph 300A and relative to time on the same X-axis as first graph 300A. The valve temperatures of graph 300B may be from exhaust passages 19 or from one or more exit points of exhaust valves 13. Time range 302A corresponds to a high engine load state (solid lines) and high engine speed state (dashed lines), while time ranges 302B correspond to a low engine load state and low engine speed state. High engine load during time range 302A corresponds to times when an internal combustion engine operates at an engine load or speed greater than approximately 40% of a maximum engine load or speed, while low engine loads and low engine speeds during time ranges 302B correspond to times when an internal combustion engine operates at an engine load or speed less than approximately 40% of a maximum engine load or speed. Time range 302C corresponds to high engine speed and low engine load.

The valve temperatures of graph 300B may correspond to the respective engine speeds and/or engine loads of graph 300A (e.g. a given valve temperature may correspond to an engine speed or engine load at the same time on graph 300A). For example, the high engine load and high engine speed during time range 302A corresponds to the relatively higher valve temperatures 312 and the low engine load and low engine speed during time ranges 302B correspond to the relatively lower valve temperatures 314 and 315, as first graph 300A and graph 300B are plotted on a common X-axis.

FIG. 3 further shows valve temperatures 306 and valve temperature 304. Valve temperatures 306 are temperatures corresponding to a plurality of valves 13 or exhaust passages 19 and temperature 304 is a temperature corresponding to a set of valves 13 or exhaust passage 19 that may exhibit abnormal performance. Together, temperatures 306 and temperature 304 may correspond to temperature signals 70A-70J generated at temperature sensors 15A-15J of FIG. 1. Representative temperature 308 may be output by representative temperature identifier 204 of FIG. 2, and may be based on each of the temperatures 306 and temperature 304 for a particular engine bank.

FIG. 4 is a flowchart illustrating an exemplary process for method 400 performed by engine system 10 with ECM 80 and/or remote system 82. At step 402, ECM 80 and/or remote system 82 may receive temperature signals (e.g., temperature signals 70A-70J) from a plurality of temperature sensors (e.g., temperature sensors 15A-15J). The temperature signals may correspond to temperatures at respective exhaust passages 19 or exit points of exhaust valves 13. The temperatures may correspond to temperatures 306 and temperature 304 of FIG. 3. The temperature signals may be received at input module 202. The temperatures may be provided to representative temperature identifier 204, as described above.

At step 404, a representative temperature may be determined by ECM 80 and/or remote system 82 based on at least two of the temperatures received at 402 (e.g., via temperature signals). In particular, representative temperature identifier 204 of ECM 80 and/or remote system 82 may identify the representative temperature. If a given engine 14 has multiple engine banks (e.g., engine bank 14A and 14B), then multiple respective temperatures may be determined, based on valve temperatures from valves 13A, 13B corresponding to each respective engine bank 14A, 14B. For example, representative temperatures 308 of FIG. 3 may correspond to the mean values of temperatures 306 and temperature 304.

At step 406, each of a plurality of temperatures received at step 402 may be compared by ECM 80 and/or remote system 82 to the representative temperature determined at step 404. The comparison may be conducted by comparator 206 that may determine the difference between each of the plurality of temperatures received at step 402 and the representative temperature determined at step 404. The difference values may be stored in a local or remote cache or memory.

At step 408, a caution temperature (e.g., a caution exhaust passage temperature or a caution valve temperature) may be identified by ECM 80 and/or remote system 82. The caution temperature may be one of the temperatures received at step 402. The caution temperature may be a temperature that is greater than the representative temperature by a warning threshold amount. Accordingly, the caution temperature may be the temperature of exhaust at an exhaust passage 19 or valve 13 that is greater than a representative temperature for all exhaust passages 19 and/or valves 13, by at least a warning threshold amount. The caution temperature may indicate an incomplete closure or valve fracture of a valve 13 that the caution temperature corresponds to. For example, an incomplete closure of a given valve 13 may cause hot air during combustion to escape the valve 13. These hot exhaust components may and elevate the temperature of temperature may be captured by a temperature sensor (e.g., temperature sensors 15A-15J) located at a valve exist or at an exhaust passage that receives exhaust air from the valve.

At step 410, a result may be output based on identifying a caution temperature at step 408. For example, at 410, ECM 80 and/or remote system 82 may output an abnormal exhaust valve performance indication (e.g., a notification, a warning, a signal, an alert, etc.). The result may be based on the caution temperature identified at 470 itself (e.g., if the caution temperature is a warning threshold amount greater than a representative temperature, if the caution temperature is a modification threshold amount greater than a representative temperature, etc.). The result may be initiated by ECM 80 and/or remote system 82 and may be output to, for example, an engine component 210, display 212, and/or external device 214 as signals. The result may cause a warning (e.g., a visual, audio, haptic, or other notification) or a modification in an operation (e.g., an engine component 210 modification).

According to an implementation, multiple representative temperatures may be identified for an engine with multiple engine banks (e.g., engine banks 14A and 14B of FIG. 1). One representative temperature may be identified per bank, based on the temperature signals corresponding to valves and/or exhaust passages associated with each bank. Accordingly, each of the temperatures associated with a bank may be compared to the representative temperature associated with that bank. Based on the comparison, a caution temperature may be identified for a given bank based on the representative temperature for that bank.

According to an implementation, one or more of steps 402, 404, 406, 408, and/or 410 may be performed during or based on low engine load and/or engine speed time periods. For example, a representative temperature may be determined at step 404 only when the engine operates under a low load and/or operates below a predetermined engine speed. Alternatively, or in addition, a caution temperature (e.g., corresponding to a given valve set or exhaust passage) may be identified at step 408 from temperatures sensed while the engine operates under a low load and/or low speed. Alternatively, or in addition, an output at step 410 (e.g., a warning or modification signal) may be generated based on temperatures sensed while the engine operates under a low load and/or low speed. According to an implementation, caution temperatures identified at 408 may indicate abnormal valve performance most effectively during both low load and low engine speed operations. For example, with reference to FIG. 3, valve temperatures detected at 315 (i.e., during a low load and low engine speed operation 302B), may be used to determine abnormal valve performance.

Identifying a caution temperature and outputting a result (e.g., a warning, a modification, etc.) may detect abnormal valve performance to mitigate and or prevent damage to engine system 10. For example, identifying a caution temperature and outputting a warning may trigger maintenance or replacement of a valve or valve set. The maintenance or replacement of the valve or valve set may resolve the abnormal valve performance and may prevent further damage to engine system 10. Detection of abnormal valve performance in accordance with the techniques disclosed herein may prevent or mitigate degradation in performance and/or correction of the incomplete closure, valve fracture, or other condition. Accordingly, identification of a caution temperature may prevent damage to an engine, may prolong the life of the engine, and/or may reduce the maintenance costs associated with the engine.

It will be apparent to those skilled in the art that various modifications and variations can be made to the disclosed method and system without departing from the scope of the disclosure. Other embodiments of the method and system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. A method for identifying abnormal exhaust valve performance of an internal combustion engine, the method comprising:

receiving exhaust passage temperature signals from a plurality of exhaust passage temperature sensors, each exhaust passage being fluidly connected downstream of one or more exhaust valves of a same cylinder of the internal combustion engine, the exhaust passage temperature signals being indicative of respective exhaust passage temperatures;

comparing one or more of the exhaust passage temperatures;

identifying a caution exhaust passage temperature, from one or more of the exhaust passage temperatures, that deviates from one or more of the other one or more exhaust passage temperatures; and outputting an abnormal exhaust valve performance indication based on identifying the caution exhaust passage temperature.

2. The method of claim 1, wherein comparing one or more exhaust passage temperatures further comprises determining a representative temperature based on the exhaust passage temperatures and comparing one or more of the exhaust passage temperatures to the representative temperature, and the method further comprising identifying the caution exhaust passage temperature is greater than at least a warning threshold temperature above the representative temperature.

3. The method of claim 2, wherein the plurality of exhaust passages correspond to a first bank of cylinders in the internal combustion engine, the method further comprising:

receiving second exhaust passage temperature signals from each of a plurality of second exhaust passages corresponding to a second bank of cylinders in the internal combustion engine, each second exhaust passage connected to one or more second exhaust valves, the second exhaust passage temperature signals being indicative of respective second exhaust passage temperatures;

determining a second representative temperature based on each of the second exhaust passage temperatures; and comparing one or more of the second exhaust passage temperatures to the second representative temperature, wherein identifying the caution exhaust passage temperature further comprises identifying the caution exhaust passage temperature from one or more of the second exhaust passage temperatures.

4. The method of claim 2, wherein the representative temperature is a mean of at least two of the exhaust passage temperatures.

5. The method of claim 2, wherein the representative temperature is determined based on a mathematical relationship between each of the exhaust passage temperatures.

6. The method of claim 2, further comprising modifying an amount of fuel injected by a fuel injector based on the exhaust passage temperature exceeding a modification threshold temperature above the representative temperature.

7. The method of claim 6, wherein at least one of a warning threshold temperature or the modification threshold temperature are based on the representative temperature.

8. The method of claim 7, wherein a higher representative temperature corresponds to a higher warning threshold temperature or modification threshold temperature and a relatively lower representative temperature corresponds to a lower warning threshold temperature or modification threshold temperature.

9. The method of claim 1, wherein the exhaust passage temperature signals are detected by respective exhaust passage temperature sensors secured to each exhaust passage.

10. The method of claim 1, further comprising outputting an abnormal exhaust valve performance warning based on the abnormal exhaust valve performance indication wherein the warning identifies an engine cylinder corresponding to the caution exhaust passage temperature.

11. The method of claim 10, wherein the abnormal exhaust valve performance warning is output prospective of an incomplete closure condition or valve fracture of an exhaust valve associated with the caution exhaust passage temperature.

12. A method for identifying abnormal valve performance of an internal combustion engine, the method comprising:

determining that the internal combustion engine is operating below a predetermined engine load, below a predetermined engine speed, or both;

receiving valve temperature signals from a plurality of temperature sensors, the valve temperature signals corresponding to respective valve temperatures;

determining a representative temperature based on the valve temperatures;

in response to determining that the internal combustion engine is operating below the predetermined engine load, below the predetermined engine speed, or both, identifying when one or more of the valve temperatures is greater than a threshold temperature above the representative temperature; and outputting an abnormal valve performance indication based on identifying the one or more valve temperatures is greater than the threshold temperature.

13. The method of claim 12, wherein the plurality of valves correspond to a first bank of cylinders in the internal combustion engine and further comprising:

receiving second valve temperature signals from each of a plurality of second valves corresponding to a second bank of cylinders in the internal combustion engine, the second valve temperature signals being indicative of respective second valve temperatures;

determining a second representative temperature based on each of the second valve temperatures; and comparing one or more of the second valve temperatures to the second representative temperature, wherein identifying when one or more of the valve temperatures is greater than a threshold temperature above the representative temperature further comprises identifying when one or more of the second valve temperatures is greater than a threshold temperature above the representative temperature and outputting an abnormal valve performance is further based on the one or more second valve temperatures.

14. The method of claim 12, wherein the predetermined engine speed is less than approximately 40% of a maximum engine speed.

15. The method of claim 12, further comprising adjusting the representative temperature based on the valve temperatures.

16. The method of claim 12, further comprising reducing an amount of fuel injected by a fuel injector based on the valve temperature exceeding a modification threshold temperature that is higher than the representative temperature.

17. An abnormal exhaust valve performance detection system, comprising:

an internal combustion engine comprising:

a plurality of exhaust passages, each exhaust passage being connected to one or more exhaust valves of the internal combustion engine;

a plurality of temperature sensors, each temperature sensor secured to a respective exhaust passage; and a control unit configured to:

receive exhaust passage temperature signals from each of the plurality of temperature sensors, the exhaust passage temperature signals being indicative of respective exhaust passage temperatures;

determine a representative temperature based on each of the exhaust passage temperatures;

compare one or more of the exhaust passage temperatures to the representative temperature;

identify a caution exhaust passage temperature, from one or more of the exhaust passage temperatures, that is greater than at least a threshold temperature above the representative temperature, based on the comparison; and output an abnormal exhaust valve performance indication based on identifying the caution exhaust passage temperature wherein the abnormal exhaust valve performance indication identifies an engine cylinder corresponding to the caution exhaust passage temperature.

18. The system of claim 17, further comprising a plurality of fuel injectors connected to the exhaust valves, wherein the control unit is further configured to transmit a fuel injector shutoff signal based on the caution exhaust passage temperature exceeding a modification threshold temperature above the representative temperature, the modification threshold temperature being greater than the threshold temperature.

19. The system of claim 17, wherein the representative temperature is based on a relationship between each of the exhaust passage temperatures.

20. The system of claim 17, wherein each of the plurality of temperature sensors protrude partially inside respective exhaust passages.

* * * * *